US008231478B1

(12) United States Patent
Cox

(10) Patent No.: US 8,231,478 B1
(45) Date of Patent: Jul. 31, 2012

(54) GOLF CLUB

(76) Inventor: Michael A. Cox, Wilmette, IL (US)

( * ) Notice: Subject to any disclaimer, the term of this patent is extended or adjusted under 35 U.S.C. 154(b) by 0 days.

(21) Appl. No.: 13/048,542

(22) Filed: Mar. 15, 2011

(51) Int. Cl.
*A63B 69/36* (2006.01)

(52) U.S. Cl. ..... 473/219; 473/386

(58) Field of Classification Search ..... 473/173, 473/180, 219, 226, 229, 242, 244, 251, 257
See application file for complete search history.

(56) References Cited

U.S. PATENT DOCUMENTS

| | | | | | |
|---|---|---|---|---|---|
| 3,273,893 | A | * | 9/1966 | Duncan | 473/238 |
| 3,623,732 | A | | 11/1971 | Peeples | |
| 3,632,112 | A | | 1/1972 | Jacobs | |
| 3,663,049 | A | | 5/1972 | James | |
| 3,698,720 | A | | 10/1972 | Gudmundsen | |
| 3,758,117 | A | * | 9/1973 | Harrison | 473/231 |
| 3,897,059 | A | | 7/1975 | McCulloch | |
| 3,997,169 | A | | 12/1976 | Bergstrom | |
| 4,290,603 | A | | 9/1981 | Barnes | |
| 4,486,019 | A | | 12/1984 | Sievers | |
| 4,509,751 | A | | 4/1985 | Tabet | |
| 4,515,402 | A | | 5/1985 | Sedan | |
| 4,552,358 | A | | 11/1985 | McGlew | |
| 4,819,938 | A | | 4/1989 | Hill | |
| 4,877,251 | A | * | 10/1989 | Faust | 473/180 |
| 5,004,240 | A | | 4/1991 | Tsukamoto | |
| 5,209,470 | A | | 5/1993 | Cimaroli | |
| 5,328,174 | A | | 7/1994 | Reeder | |
| 5,441,270 | A | * | 8/1995 | Williams | 473/251 |
| 5,485,999 | A | | 1/1996 | Hull et al. | |
| 5,501,453 | A | | 3/1996 | Hurst | |
| 5,921,598 | A | | 7/1999 | Bredow | |
| 5,997,409 | A | | 12/1999 | Mattson | |
| 6,083,115 | A | | 7/2000 | King | |
| 6,199,926 | B1 | | 3/2001 | Lemoine | |
| 7,731,599 | B1 | * | 6/2010 | Caserta et al. | 473/236 |
| 2007/0184918 | A1 | | 8/2007 | Ritchie, Jr. | |
| 2008/0280700 | A1 | | 11/2008 | Ritchie, Jr. | |

* cited by examiner

*Primary Examiner* — Nini Legesse
(74) *Attorney, Agent, or Firm* — Beem Patent Law Firm

(57) ABSTRACT

A golf facilitating device (sometimes herein referred to as a "golf club" or a "Gimme Club") is disclosed. The golf club may include a shaft, a club head coupled to the shaft, and a rotatable guiding mechanism coupled to at least one of the shaft and the club head. The guiding mechanism may include at least one guardrail, and a receptacle coupled to the at least one guardrail, wherein the rotatable guiding mechanism facilitates guiding a golf ball between a first position and a second position.

8 Claims, 4 Drawing Sheets

GOLF CLUB

BACKGROUND

Golfers and golf course operators have long been aware of the slow golfer's negative impact on the flow of play. Golf play typically involves a group of golfers playing a number of holes in a given order. For example, a round of golf typically includes 18 holes that are played in the order determined by the course layout. To facilitate flow around the golf course, only one group is permitted at each hole at any one time. The golf course staggers the start times for the groups of players in an effort to maximize playing efficiency. However, as play progresses, a classic problem arises; the slowest group dictates the pace of play for everyone behind them. The queuing problem creates frustration among players as they wait extended periods of time for the golfers ahead of them to clear a hole. According to a golf digest survey, over three million golfers quit the game each year, and over 50% of those cite frustration over slow play as their reason for quitting.

Slow play adversely affects the game of golf in multiple respects, including decreasing the number of groups that can queue through the course in one day, decreasing golf course revenues, and increasing golf attrition.

BRIEF SUMMARY

A golf facilitating device is disclosed (sometimes herein referred to as "golf club" or "Gimme Club"). The golf club may include a shaft, a club head coupled to the shaft, and a rotatable guiding mechanism coupled to at least one of the shaft and the club head. The guiding mechanism may include at least one guardrail, and a receptacle coupled to the guardrail, wherein the rotatable guiding mechanism facilitates guiding a golf ball between a first position and a second position.

A method of using a golf club is disclosed. The golf club may include a shaft, a club head and a guiding mechanism that is coupled to at least one of the shaft and the club head. The method may include rotating a guiding mechanism between a first position and a second position, wherein the guiding mechanism is substantially parallel to the shaft in the first position and wherein the guiding mechanism is angled with respect to the shaft in the second position.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION OF THE INVENTION

Figure 1:
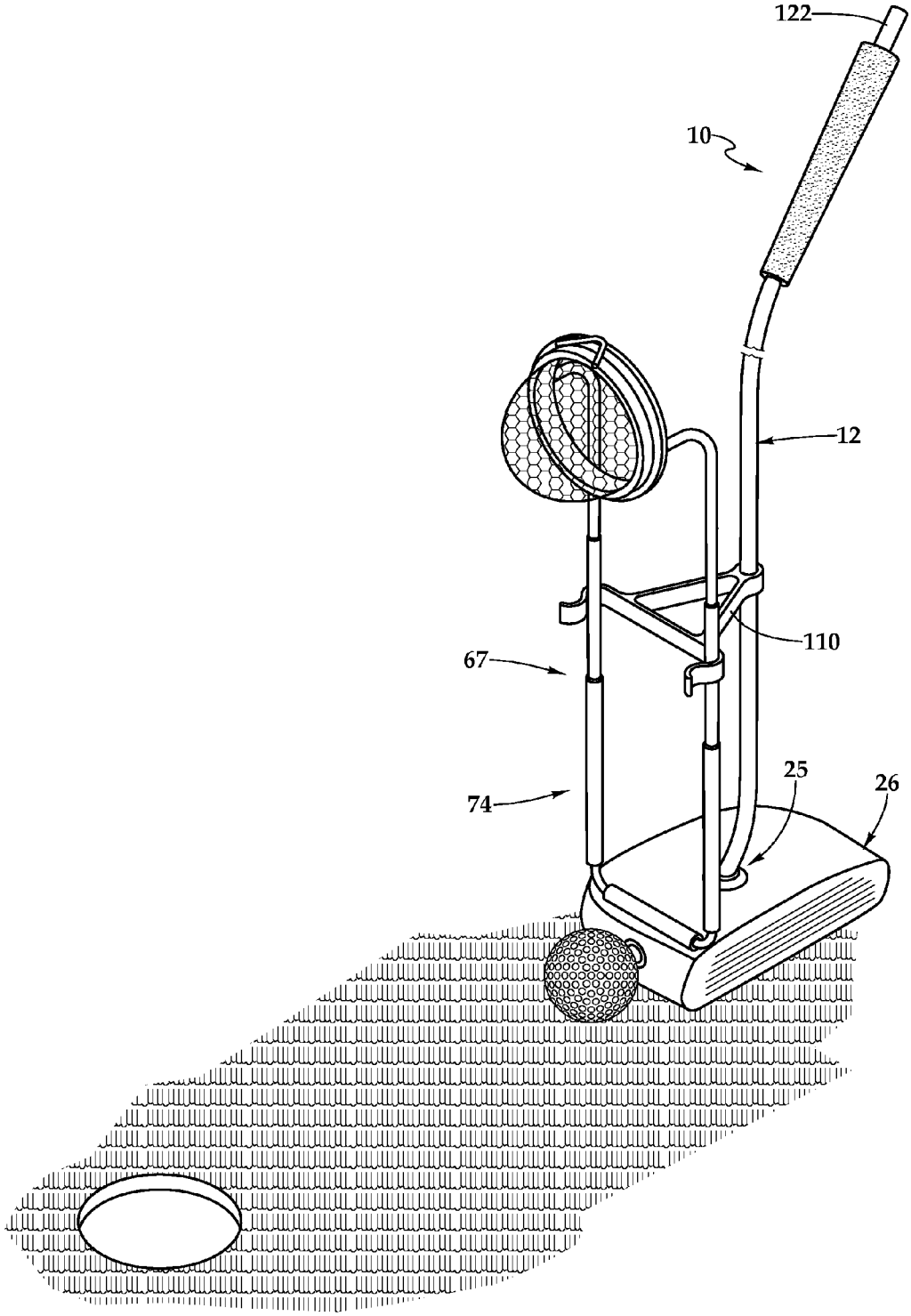
FIG. 1 is a perspective view of a golf club with a guiding mechanism in a stored position.
Figure 2:
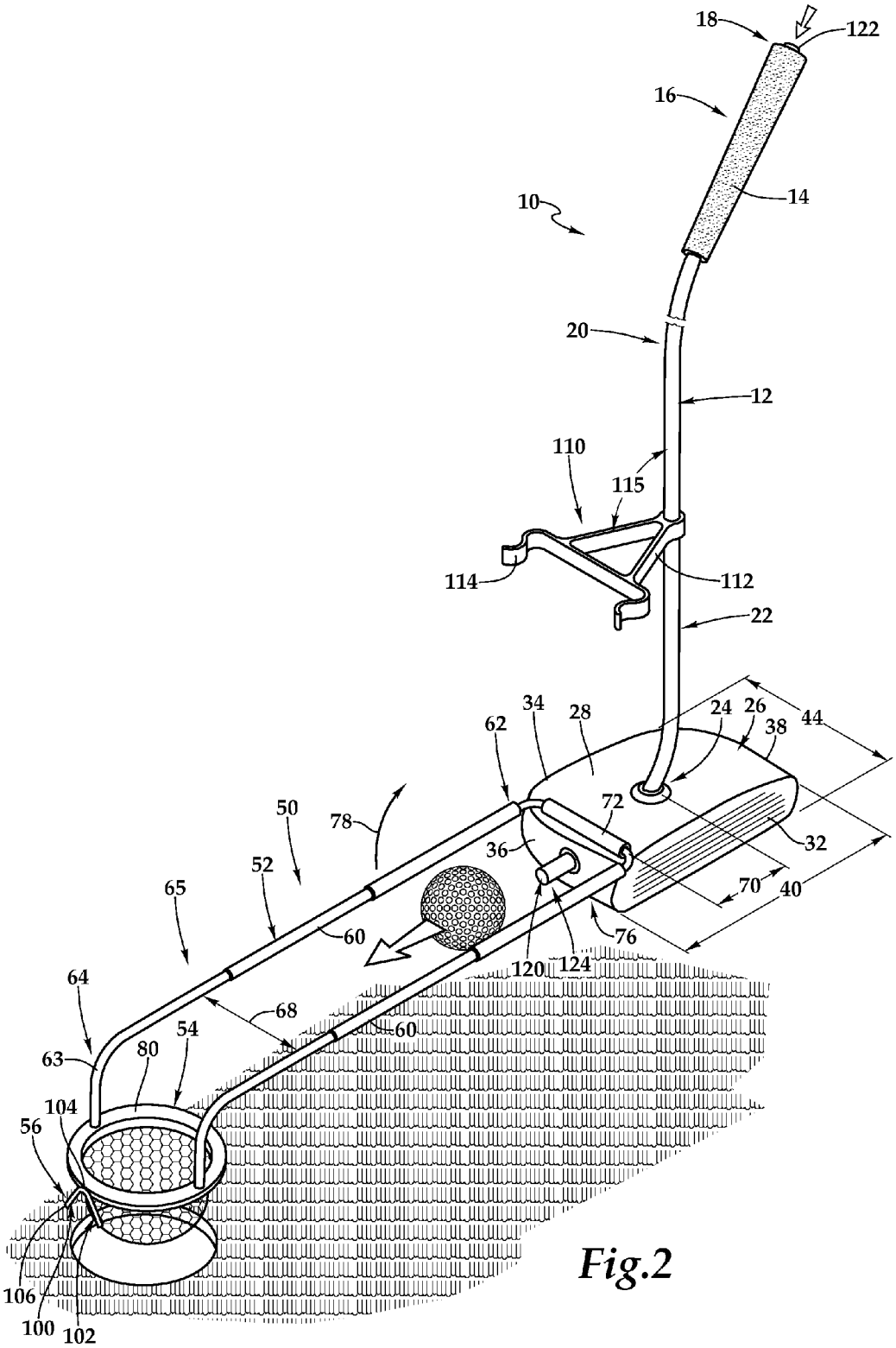
FIG. 2 is a perspective view of the golf club of FIG. 1 with the guiding mechanism in an operative position.
Figure 3:
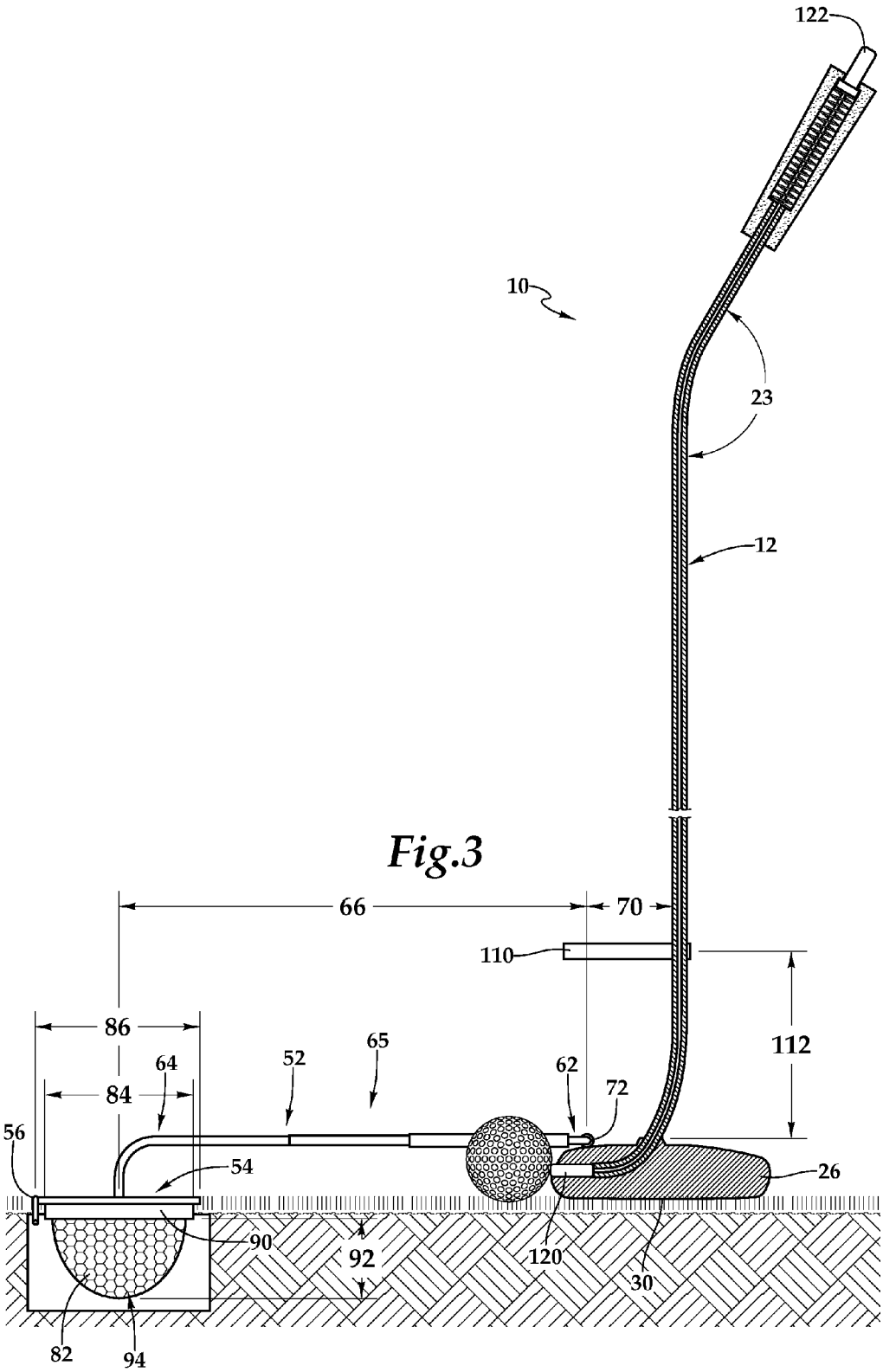
FIG. 3 is a side view of the golf club of FIG. 1 with the guiding mechanism in the stored position.
Figure 4:
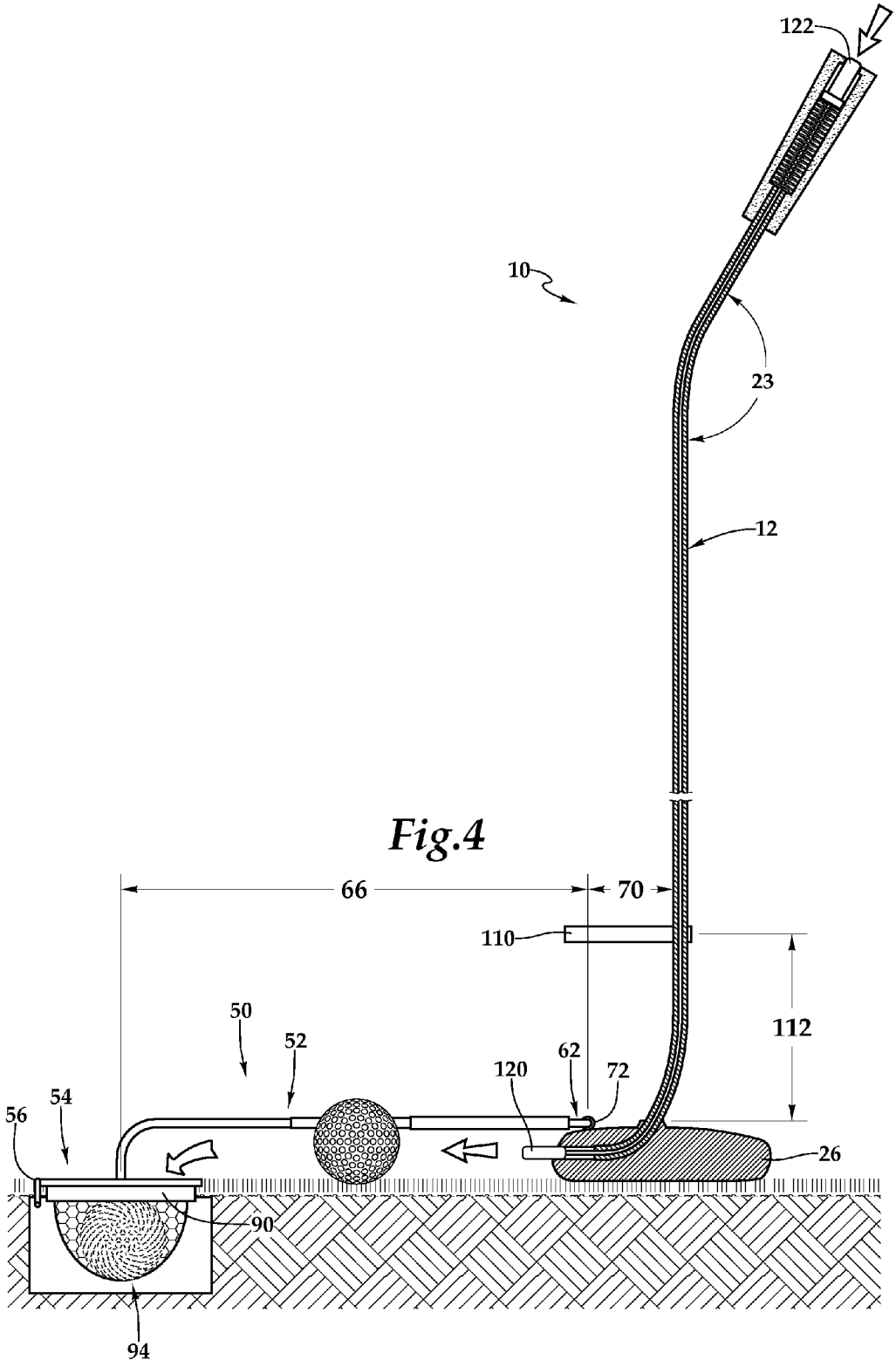
FIG. 4 is a side view of the golf club of FIG. 1 with the guiding mechanism in the operative position.

The Gimme Club or golf club streamlines golf play, as well as promotes consistency, fairness, and convenience on the putting green.

In the sport of golf, a gimme (derived from a contracted form of the phrase "give me"), is a putt that is granted to a fellow player as successfully made either before it is attempted or after it is missed in an informal game of golf. Gimmes are not allowed by the rules in stroke play, though the practice is common in casual matches. Even in formal match play, either player may concede a stroke, and this may not be refused or withdrawn. Indeed, Golfs Rule 2-4 sanctions the use of gimmes, providing "[a] player may concede his opponent's next stroke at any time." In other words, one player can tell another to simply pick up his ball in lieu of putting, add a stroke to his score and proceed to the next hole. During a round between average golfers, a gimme can serve purposes other than competition. There are friendly "no worries, pick it up" gimmes, the "hurry-up-we're-a-hole-behind" gimme, and the commonly used "force gimme." In short, a gimme is one of the many polite peculiarities golf prides itself on as a gentleman's game.

But gimmes are hardly simple and sometimes not so gentlemanly. The advantage of the Gimme Club is that it promotes fair and quicker play. The rules have never required a golfer to offer a gimme. A generous player might tell his opponent to pick up a 10-foot putt, or a stingy one could refuse to concede a two-inch putt. Alternatively, a golfer may vary the gimmes offered throughout a match, conceding long putts during the front nine holes while refusing similar concessions as to even shorter putts on the back nine holes. There can be a lack of consistencies in gimmes. The Gimme Club allows for players to evaluate whether a putt fits within the parameters of the generally recognized distance for a gimme—a putt that is 20 inches or less. As such, the Gimme Club does not violate the rules of golf. The whole point of a gimme is concession; the Gimme Club standardizes those concessions upon player agreement prior to a round of 18 holes. Put another way, players may find the Gimme Club as a far superior and formal method of conceding putts versus the current less informal and ad hoc means now prevalent in the game of golf.

The Gimme Club can neutralize disputes as to appropriate conditions for a "gimme," especially where players have big bets on the line in their game. Denying a golfer an obvious gimme not only creates the potential for tension, but it also unnecessarily prolongs a golf game. Indeed, if a golfer was refused a gimme, it is natural for him to take an inordinate amount of time trying to line up the simplest of putts, examining it from all angles, and taking multiple practice swings.

Physical convenience is accounted for in the Gimme Club. The retractable golf guardrails and basket provide for an easy "catch" of the golf ball, as well as a snap up of the same to the standing player. No more bending over to collect an idle ball in the green hole—incidentally one of the primary motivations for informal gimmes. No more digging the green hole with one's putter to collect the ball or attempting to flip the ball from the green hole to snatch the ball while standing up.

For this and other reasons, many golf clubs promote the "gimme" during normal play to speed up the golfers on the greens. The Gimme Club will facilitate consistency in gimmes. For this reason, the Gimme Club may find itself alongside the bucket of "turf replacer" as a standard item that one finds on a golf cart. Golf courses even may implement a rule that players carry the Gimme Club and use it on the golf course greens to speed up play, which would allow for more tee times and better customer satisfaction.

Broadly, an embodiment of the present invention generally provides a golf club 10 for use on a golf hole with a putting green that may be surrounded by fringe and may have a pin (or flagstick) and a hole with a cup therein for receiving golf balls.

1. Golf Club 10

Turning to the figures, golf club 10 may have features similar to a putter, such as a shaft 12 with a lance or grip 14 and a club head 26, to facilitate rolling a golf ball along the grass from a predetermined point on the putting green towards a cup. Golf club 10 also may include a guiding mechanism 50 to facilitate the speed game play and the consistency of gimmes during the round of golf.

Guiding mechanism 50 may include at least one guardrail 52, a basket 54, and a grass guard 56. Golf club 10 further may include a latch 110, which may facilitate retaining guardrail 52 proximate to shaft 12, and an actuator control or button to facilitate operating an actuator 120, which may project a golf ball along guardrail 52 a distance from the predetermined point towards the cup on the putting green.

2. Shaft 12 and Grip 14

Shaft 12 may have a similar feel and use to that of a traditional putter. Shaft 12 may have a first portion 16 extending between a first end 18 and an optional bend 20 and a second portion 22 extending between optional bend 20 and a second end 24. An angle 23 may be defined between first portion 16 and second portion 22 proximate optional bend 20. Angle 23 may be between about 95 degrees and about 125 degrees, preferably between about 100 degrees and 115 degrees, and in one embodiment, about 105 degrees. Shaft 12 further may include an optional bend 25 proximate second end 24.

First portion 16 may have a length between about 6" and about 14", preferably between about 8" and 12", and in one embodiment, about 10", and second portion 18 may have a length between about 16" and about 34", preferably between about 20" and about 32" and in one embodiment, about 22". Shaft 12 may have an overall length between first end 16 and second end 18 between about 16" and about 48", preferably between about 20" and about 45" and in one embodiment, about 32". Shaft 12 may be coupled to club head 26. In one embodiment, shaft 12 may be inserted into club head 26, and in such an embodiment, shaft 12 may be slightly longer, for example, about 35".

Shaft 12 may have a substantially cylindrical shape and may be fabricated of metal, such as aluminum, carbon fiber composite, graphite, steel, plastic, any combination thereof or any suitable material. Shaft 12 may have a diameter that is between about 0.2" and about 2", preferably between about 0.5" and about 1.5" and in one embodiment, about 1". Alternatively, shaft 12 may have any shape, such as a rectangular cross-section. Shaft 12 also may be substantially hollow for at least partially retaining golf club 10 components, such as actuating components therein.

In one embodiment, shaft 12 may include an optional channel (not shown) therein. The optional channel may have a length that is substantially the same length as second portion 22. The optional channel may be configured to receive a portion of guiding mechanism, such that guiding mechanism is integrated or stored within at least a portion of shaft 12.

Golf club 10 may include a grip 14 coupled to first portion 16. In one embodiment, grip 14 may be fabricated of rubber. Alternatively, grip 14 may be fabricated of any suitable material. Grip 14 may extend downward along shaft 12 from end 16 between about 6" and about 14", preferably between about 8" and 12", and in one embodiment, about 10".

3. Club Head 26

Club head 26 may include a top surface 28 configured to couple to shaft 12. In one embodiment, head 26 and shaft 12 are welded together. Head 26 may be fabricated of metal, such as aluminum, carbon fiber composite, graphite, steel, plastic, any combination thereof or any suitable material. Further, in one embodiment, head 26 may be fabricated from the same or a similar material to that of shaft 12.

Club head 26 further may include a bottom surface 30 configured to contact the grass on the putting green when club 10 is in use, a ball striking surface 32, an opposing striking surface 34, a forward surface 36 and a rear surface 38. Each surface 28, 30, 32, 34, 36, 38 may be substantially planar or have a radius of curvature.

In one embodiment, surfaces 32 and 34 are substantially similar. Each surface 32, 34 has a length 40 between surfaces 36 and 38 that may be between about 1" and about 6", preferably between about 2" and 5", and in one embodiment, about 4". Alternatively, surfaces 32 and 34 may be different. Each surface 32, 34, 36, 38 has a height that may be between about 0.5" and about 3", preferably between about 1" and about 2.5", and in one embodiment, about 1.5". Further, in one embodiment, surfaces 36 and 38 are substantially similar. Each surface 36, 38 has a length 44 between surfaces 32 and 34 that may be between about 1" and about 5", preferably between about 2" and 4", and in one embodiment, about 1.5". In an alternative embodiment, club head 26 may have any suitable shape and size to facilitate use and operation of club 10.

Shaft 12 may be substantially centered on head 26, such that shaft 12 is about half way between surfaces 32 and 34 and about half way between surfaces 36 and 38.

An actuator, discussed below in more detail, may be coupled to or adjacent to at least one surface of head 26, such as surface 36. In one embodiment, head 26 may be substantially hollow to accommodate receiving and/or retaining a portion of actuator and/or guiding mechanism 50.

4. Guiding Mechanism 50

Guiding mechanism 50 may include at least one guardrail 52, a receptacle 54, and an optional grass guard 56 and is configured to provide for standardization and consistency among players to definitively determine whether a ball is within "gimme" distance. Guiding mechanism 50 further may safeguard green conditions around the hole, speed up play, and facilitate accomplishing a "gimme" putt without missing or having to twist or bend over to collect the ball upon its entering the hole.

4A. Guardrail 52

Guardrail 52 may be coupled to shaft 12 and/or head 26. Guardrail 52 may facilitate measuring whether the distance between a golf ball and the hole on the putting green fit within the generally accepted norms of a "gimme." For example, a generally accepted norm of a "gimme" may be between about 0.1" and about 36", preferably between about 2" and about 24", and in one embodiment, about 22". The guardrail 52 facilitates providing standardization and consistency during play, also facilitates determining whether a ball is within "gimme" distance, and further facilitates guiding a ball towards a hole on the green. In one embodiment, guardrail 52 may be retractable, telescoping or rotate to allow golfers to retrieve their ball from the ground without having to twist or bend down.

Guardrail 52 may be configured to abut shaft 12 and/or may be flush with shaft 12. In another embodiment, guardrail 52 may be integrated into shaft 12, such that guardrail 52 is hidden from view when guardrail 52 is not in use.

Guardrail 52 may extend between an extended position 65 and a collapsed position 67. Guardrail 52 may include at least one shaft 60 and has a length 66 between a first end 62 and an opposing second end 64. Length 66 may be between about 0.1" and about 36", preferably between about 2" and about 24", and in one embodiment, about 20".

In one embodiment, first end 62 may be proximate second end 24 of shaft 12, wherein first end 62 may be coupled to shaft 12 and/or club head 26. In another embodiment, first end 62 may be coupled to club head 26 proximate surface 38. In a further embodiment, first end 62 may be coupled a distance 70 from second end 24 of shaft 12. For example, distance 70 may be about one inch.

In one embodiment, guardrail 52 includes a pair of substantially parallel shafts 60, wherein a distance 68 is defined between shafts 60, such that a golf ball may roll along or between shafts 60. In other words, distance 68 may between about 0.1" and about 3", preferably between about 0.5" and about 2.5" and in one embodiment, about 2.25". This may perpetuate longevity, particularly for retraction upon lining up the necessary distance of the device from the hole. In another embodiment, distance 68 may be no wider than the diameter of a golf ball or no wider than about 1.68 inches. Further, in one embodiment, each shaft 60 may telescope. Additionally, in one embodiment, each shaft 60 may include a bend 63 proximate end 64 to facilitate aligning receptacle 54 with the hole on the golf green. Alternatively, in one embodiment, each shaft 60 does not include bend 63.

In an alternative embodiment, shafts 60 are not substantially parallel but are angled towards one another. For example, in such an embodiment, distance 68 proximate the shaft is about 1.75 times the diameter of a golf ball, where the diameter of the golf ball may be about 1.68 inches, i.e., 1.75 multiplied by about 1.68 inches is about 3 inches. Distance 68 proximate basket 54 is about 1.25 times the diameter of a golf ball, where the diameter of the golf ball may be about 1.68 inches, i.e., 1.25 multiplied by about 1.68 inches is about 2 inches. The width spans between these distance 68 proximate the shaft and distance 68 proximate the basket are to be bridged by straight guardrails that obtusely meet together as a result of a consistent curve.

Each shaft 60 may have a substantially cylindrical shape and may be fabricated of metal, such as aluminum, carbon fiber composite, graphite, steel, plastic, any combination thereof or any suitable material. Each shaft 60 may have a diameter that is between about 0.1" and about 2", preferably between about 0.25" and about 1.5" and in one embodiment, about 0.5". Alternatively, each shaft 60 may have any shape, such as a rectangular cross-section. In an alternative embodiment, shaft 60 may taper between first end 62 and opposing second end 64. For example, each shaft 60 may have a diameter of about 0.75 inches proximate first end 62 and a diameter of about 0.5 inches proximate second end 64. Each shaft 60 also may be substantially hollow for at least partially retaining golf club 10 components, such as actuating components therein, or to facilitate translating each shaft 60 in a telescoping manner. Each shaft 60 may comprise a plurality of components (not shown) such that, in one embodiment, components may fit within one another to facilitate translating or telescoping each shaft 60 between a multitude of positions, such as a first position and a second position.

Translating shaft 60 between a first position and a second position facilitates accommodating "gimmes" of different lengths. Shaft 60 may be translated between various positions, where telescoping components of shaft 60 may lock into predetermined locations. Shaft 60 may be locked in those positions through the use of openings and bearings or other suitable mechanisms that fit therein. For example, shaft 60 may include a row of openings and a ball bearing that may fit therein to lock shaft 60 into at least one predetermined location. Alternatively, shaft 60 may extend and/or retract in other ways. For example, shaft 60 may extend and/or retract through the use of springs and/or electronic components.

Each shaft 60 may be coupled to shaft 12 and/or club head 26 with at least one connection 72. In one embodiment, guardrail 52 may include a connection 72 proximate end 62. Alternatively, each shaft 60 may include a connection 72, rather than a single connection 72.

Connection 72 may be metal or medium to high grade plastic ball bearings and/or rods to facilitate rotating and/or swinging guardrail 52 between a stored position 74 and an operative position 76. In stored position 74, guardrail 52 may be substantially collinear or substantially planar with shaft 12 and may be substantially perpendicular to club head 26, such as surface 28 of club head 26. In one embodiment, surface 28 of club head 26 may include at least one channel for receiving at least one shaft 60 therein. In operative position 76, guardrail 52 may be substantially collinear or substantially planar with club head 26, such as surface 28 of club head 26, and may be substantially perpendicular to shaft 12. Moreover, while moving or rotating guardrail 52 between stored position 74 and operative position 76, guardrail 52 may be angled with respect to shaft 12 and/or club head 26. In use, a player using club 10 may pull up or tug on club 10, preferably proximate end 18 of shaft 12, such that the force from pulling on club 10 may facilitate rotating guardrail 52 in an upward direction 78 towards shaft 12, such that guardrail 52 may pivot at connection 72. In stored position 74, a latch 110, discussed below in more detail, may facilitate retaining or maintaining guardrail 52 proximate and substantially parallel to shaft 12.

4B. Receptacle 54

Receptacle or basket 54 may be coupled to guardrail 52 proximate end 64. Basket 54 may safeguard green conditions around the hole, speed up play, and be configured to capture a golf ball upon entering the hole without having to twist or bend over to pick up the ball thereafter.

In one embodiment, basket 54 is welded or permanently coupled to guardrail 52. In an alternative embodiment, basket 54 is removably coupled to guardrail 52 to facilitate replacing basket 54.

Basket 54 may include a frame or rim 80 and a net 82. Rim 80 may be fabricated of medium to high grade plastic, steel, aluminum any combination thereof or another suitable material. Rim 80 may be similar in size to the diameter of a golf hole, such that rim 80 may be aligned with the entrance to the golf hole. Rim 80 may have an inner diameter 84 and an outer diameter 86. In one embodiment, inner diameter 84 may be about one inch less than outer diameter 86. Inner diameter 84 may be between about 1" and about 6", preferably between about 2" and about 5" and in one embodiment, about 4.25", and outer diameter 86 may be between about 2" and about 7", preferably between about 3" and about 6" and in one embodiment, about 5.25". Additionally, rim 80 may have a height between a top surface and a bottom surface, wherein the height is between about 0.1" and about 1.5", preferably between about 0.2" and about 1" and in one embodiment, about 0.75".

Further, rim 80 may be substantially hollow to facilitate accommodating a possible internal grass guard that may include springs. Rim 80 also may have a surface diameter between between about 0.1" and about 1.5", preferably between about 0.2" and about 1" and in one embodiment, about 0.6", such a surface diameter may accommodate for movement of grass guard 56.

Additionally, basket 54 may include a space or gap near connection to guardrail 52 to prevent a golf ball that is rolling between shafts 60 to get stopped by rim 80, rather the gap enables golf ball to roll past end 64 of guardrail 52 and into net 82 and/or a golf hole. Specifically, the gap may be between about 0.1" and about 2.5", preferably between about 0.5" and about 2.25" and in one embodiment, about 1.75". In one embodiment, the gap extends a distance that is about the same distance 68 between shafts 60.

Net 82 may be coupled to rim 80 and may be configured to hang downward therefrom. In one embodiment, net 82 may be coupled proximate the bottom surface of rim 82 such that net 82 does not inhibit a golf ball from rolling past end 64 of guardrail 52 and into net 82 and/or a golf hole. Net 82 may be fabricated of medium to high grade mesh netting, rope, plastic, vinyl, any combination thereof or another suitable material.

In one embodiment, net 82 may include fused or tied small loops. Net 82 may have an ingress or opening 90, wherein opening 90 be proximate rim 80 and may be similar in size to the diameter of a golf hole or similar in size to rim 80. Net 82 also may have a height 92 between ingress 90 and an end 94, wherein height 92 may be between about 2" and about 7", preferably between about 3" and about 6", and in one embodiment, about 5". End 94 may be closed to facilitate retaining a golf ball within net 82. In one embodiment, net 82 has a height such that end 94 may rest within or contact the bottom of the golf hole and may increase the likelihood of the golf ball remaining in net 82 when guardrails are rotated and/or moved.

4C. Grass Guard 56

Guiding mechanism 50 may include an optional grass guard 56. Grass guard 56 may be coupled to and extend from basket 54 to safeguard the grass on the putting green, particularly the grass around the hole. Further, grass guard may facilitate retracting the guardrail or guardrails 52.

Optional grass guard 56 may be coupled to receptacle 54 via a connection. In one embodiment, grass guard 56 may be opposite of a gap in rim 80. Grass guard 56 may be fabricated of medium to high grade plastic, steel, aluminum, any combination thereof or another suitable material. In one embodiment, receptacle 54 and grass guard 56 may be fabricated from substantially the same material.

The connection may be metal or medium to high grade plastic ball bearings and/or rods to facilitate rotating grass guard 56 between a stored position and an operative position. In the stored position, grass guard 56 may be substantially flush with rim 80. In one embodiment, rim 80 may include at least one channel for receiving at least a portion of grass guard 56 therein, when grass guard 56 is in the stored position. In operative position, grass guard 56 may be substantially perpendicular to rim 80 and/or guard rails 56. Moreover, while moving or rotating grass guard 56 between the stored position and operative position, grass guard 56 may be angled with respect to rim 80 and/or receptacle 54. In use, a player using club 10 may pull up or tug on club 10, preferably proximate end 18 of shaft 12, such that the force from pulling on club 10 may facilitate rotating grass guard 56 between stored position and operative position, such that grass guard 56 may pivot at the connection.

Grass guard 56 further may have at least one leg. In one embodiment, grass guard 56 has two legs 100 and 102, wherein each leg has a first end 104 that couples to rim 80 and/or net 82 and an opposing second end 106. When grass guard 56 is in use, second end 106 may be configured to contact the grass or ground. Each leg 100 and 102 may have a length between first end 104 and second end 106, wherein the length is between about 0.1" and about 3", preferably between about 0.5" and about 2.5" and in one embodiment, about 2". Each leg 100 and 102 also may have a diameter, wherein the diameter is between about 0.1" and about 1", preferably between about 0.25" and about 0.75" and in one embodiment, about 0.5". Alternatively, leg 100 and leg 102 may have different diameters and/or different lengths.

In one embodiment, each leg 100 and 102 is coupled to rim 80 and/or net 82 via the connection, such that first ends 104 are coupled together and second ends 106 are separated by a distance. Distance may be between about 0.1" and about 3", preferably between about 0.5" and about 2.5" and in one embodiment, about 2". Further, each leg 100 and 102 may form an angle with the ground, wherein the angle may be between about 30 degrees and about 70 degrees, preferably between about 40 degrees and about 50 degrees and in one embodiment, about 45 degrees. In an alternative embodiment, each leg 100 and 102 may have a distance spaced between first ends 104.

Grass guard 56, specifically each leg 100 and 102, may have one or more springs coupled therein to facilitate use of guiding mechanism 50. One or more springs may be coupled within each leg 100 and also may be coupled to or within rim 80.

When in use, in one embodiment, second ends 106 of legs 100 and 102 of grass guard 56 may be configured to sit on the surface of the grass proximate the golf hole. In an alternative embodiment, legs 100 and 102 of grass guard 56 may be configured to be positioned within the golf hole such that at least a portion of the grass guard 56 may abut the interior surface of the golf hole. Further, the at least one spring may help to release and rotate and/or move guardrails 52 from the ground towards shaft 12.

In one embodiment, as shown in the figures, grass guard 56 is positioned radially outward from basket 54. In an alternative embodiment, grass guard 56 may be positioned radially inward of basket 54.

5. Latch 110

Golf club 10 may include at least one latch 110 configured to engage guiding mechanism 50 and/or guardrail 52 in stored position 74, proximate shaft 12. In one embodiment, latch 110 is coupled to or incorporated into shaft 12. Further, in one embodiment, latch 110 is coupled directly to shaft 12. Latch 110 may be any mechanism to engage guiding mechanism 50 and may be positioned anywhere along shaft 12. In one embodiment, latch 110 may slide along shaft 12.

Latch 110 may have an outward release to facilitate the operation of guiding mechanism 50 and further may facilitate engaging guiding mechanism 50 when it is swinging in the upward direction 78.

Latch 110 may be positioned a distance 112 from second end 24 of shaft 12. Distance 112 may be between about 12" and about 24", preferably between about 15" and about 22" and in one embodiment, about 20". In one embodiment, as shown in the figures, latch 110 may be configured to engage guiding mechanism 50 along guardrails 52 and just below receptacle 54.

Further, latch 110 may include at least one latch. In one embodiment, latch 110 may include a first latch and a second latch spaced therefrom for receiving guiding mechanism 50 between the first and second latch.

In one embodiment, each latch 110 may include a support portion 112 and an engaging portion 114. Each portion 112 and 114 may have a thickness between about 0.1" and about 1", preferably between about 0.25" and about 0.75" and in one embodiment, about 0.5", and portion 112 further may have a length that is between about 0.5" and about 3", preferably between about 1" and about 2.5" and in one embodiment, about 2".

Support portion 112 may form an angle 115 with shaft 12. In one embodiment, angle 115 is about 90 degrees. Engaging portion 114 may be configured to extend outward from support portion 112. In one embodiment, engaging portion 114 may be moved between a stored position and an operative position. Additionally, In one embodiment, engaging portion 114 may include a pair of fasteners or clasps or clips to engage mechanism 50, specifically each fastener of the pair may engage one or more shafts 60 of mechanism 50.

Additionally, one or more springs may be coupled between shaft 20 and latch 110. In one embodiment, springs are stored primarily within shaft 20 and may couple to a latch control (not shown). Latch control may facilitate operating latch 110 and may include a latch button. Latch button may be coupled to shaft 12 above latch 110. In one embodiment, latch button may be coupled proximate bend 20. Alternatively, latch button may be coupled proximate end 18. The latch button may be depressed by a user to operate latch 110. In one embodiment, when latch button is depressed, the tension may be released on the one or more springs, and the latch 110 may open—specifically, portion 114 may rotate or move. When the latch button is not depressed, the springs may be in tension holding latch 110, including portion 114, in an upright position.

Latch control may facilitate rotating at least a portion of latch 110, for example, engaging portion 114, between stored position and the operative position. In stored position, latch 110 may be upright and may be configured to engage guiding mechanism 50 in a substantially parallel position to shaft 12. In operative position, latch 110, specifically engaging portion 114, may be opened to be substantially collinear with portion 112, such that guiding mechanism 50 may rotate in a downward direction, opposite of upward direction 78.

6. Actuator 120

In one embodiment, golf club 10 further may include an actuator 120, wherein actuator 120 may facilitate projecting a golf ball a length, preferably within and along guiding mechanism 50. Specifically, in one embodiment, actuator 120 is actuated to facilitate moving a golf ball between a pair of guardrails 52 from proximate club head 26 towards a golf hole. Actuator 120 may be coupled to or incorporated into club head 26 and, in one embodiment, actuator 120 may be coupled to or incorporated into surface 38. In one embodiment, when actuator 120 is incorporated into club head 26, an opening may be defined in surface 38 that is between about 0.1" and about 1", preferably between about 0.25" and about 0.75" and in one embodiment, about 0.6". Actuator 120 may have a diameter between about 0.1" and about 1", preferably between about 0.25" and about 0.75" and in one embodiment, about 0.5", and actuator 120 further may have a length that is between about 0.5" and about 4", preferably between about 1" and about 3" and in one embodiment, about 2.5". Actuator 120 may extend outward from club head 26 between about 0.1" and about 3", preferably between about 0.25" and about 2" and in one embodiment, about 1.5".

Actuator 120 may be actuated to facilitate moving a golf ball a distance from proximate club head 26 towards a golf hole, such that the distance that the actuator moves the golf ball is preferably no less than about 22⅛" on standard cut grass surface of a green regardless of slope or grades.

Actuator control 122 may facilitate operating actuator 120 and may include an actuator button. Actuator button may be coupled to shaft 12 proximate end 18. The actuator button may be depressed by a user to operate actuator 120. Control 122 may facilitate actuating or moving at least a portion of actuator 120 between a stored position and an operative position 124. In the stored position, actuator 120 may be in tension or may be retracted or recoiled. In operative position 124, actuator 120 may be extended. When extended, actuator 120 may contact a golf ball to project the golf ball forward, preferably towards the golf hole along guardrails 52.

In one embodiment, one or more springs may be coupled to actuator 120 to facilitate operation of the same. Springs may be stored primarily within club head 26 and may couple to an actuator control 122. In one embodiment, when actuator button is depressed, the tension may be released on the one or more springs, and the actuator may extend outward to contact the golf ball and push it towards the golf hole. When the actuator button is not depressed, the springs may be in tension holding actuator 120 in a stored position. In one embodiment, actuator control 122 is spring loaded so that control 122 may project outward from shaft 12. Once actuator control 122 is pushed, a cable may push actuator 120 to strike the golf ball, and then actuator 120 may retract into club head 26, returning to the stored position.

In another embodiment, actuator 120 may be operated by electronic components. For example, one or more lithium, disposable or replaceable batteries may be included within club 10 to operate actuator 120. The electronic components may be activated by pressing downward on actuator control 122.

In a further embodiment, actuator 120 may be operated by pushing down on club shaft 12. For example, when club shaft is pushed down, the actuator may extend outward to contact the golf ball and push it towards the golf hole.

For the ejector mechanism or actuator 120 to effectuate the necessary force for the piston to strike the golf ball, pressing down the actuator control 122, or alternatively, pressing down on the shaft of the golf club into its club head, may serve as the means to operating the encapsulated and standard spring biased coil within the golf club or club head to operate a piston. The spring may be calibrated to allow for sufficient force to project the golf ball between the guardrails, along the length of the guardrails, into the receptacle; however, the force of the spring may be tempered to prevent the golf ball from skipping over the receptacle/golf hole.

9. Use of Golf Club 10

A player may use golf club 10 as a putter on the green, specifically by hitting the golf ball with club head 26, preferably while guiding mechanism 50 is in stored position 74. Once a golf ball is within a predetermined distance of the golf hole, a player may mark the position of the golf ball with a marker. A player then may enable the guiding mechanism 50 by using latch control to release latch 110 and unlatch guiding mechanism 50 from stored position 74. Guiding mechanism 50 should then move to operative position 76. In operative position 76, the pair of guiderails 52 may border either side of the marker and the guiderails may be pointed in the direction of the golf hole. As guiding mechanism 50 is moved into the operative position 76, receptacle 54 may be aligned with and/or positioned in the golf hole. Similarly, grass guard 56 may be positioned within or proximate to the golf hole. Additionally, as guiding mechanism 50 is moved into operative position 76, shafts 60 and/or guardrails 52 may be adjusted to a predetermined length. In one embodiment, it is preferable to position actuator 120 proximate the marker and position receptacle 54 within the golf hole, such that the shafts 60 and/or guardrails 52 are then adjusted to the distance between the marker and the golf hole. Once guiding mechanism 50 is positioned, the marker may be replaced by the golf ball.

Actuator 120 may be activated with actuator control 122. When actuator control 122 is activated or depressed, actuator 120 may move. Actuator 120 may contact a golf ball and project the golf ball forward, preferably towards the golf hole along and/or between guardrails 52 and/or shafts 60.

Golf ball then may roll towards the golf hole, preferably guided by guardrails 52 and/or shafts 60, and enter the golf hole and fall into receptacle 54. Once golf ball is in receptacle 54, the player may pull-up on golf club 10 to facilitate rotating guiding mechanism 50, with the golf ball in receptacle 54, between operative position 76 and stored position 74. This may prevent the player from having to twist or bend over to collect the ball.

Upon the golf ball landing in the mesh netting or receptacle 54, a golfer is afforded the opportunity of allowing the guardrails to return to the shaft by simply lifting and swinging the golf club upwards, whereupon Newtonian principles dictate that gravity may effectively force a connection. A small latch at the base of the club, proximate end 24, and/or latch 110 may catch the guardrails. The incentive to do this is clear: a golfer need not stoop down and collect the ball from the mesh basket where the less burdensome manner is to use the golf club as directed. Wherever truncated, the golfer may simply extend the guardrails to the status quo should any users failed to do the same beforehand. The golf club also provides an easier and readily achievable means of accommodating individuals with disabilities, especially those with compromised backs, vertigo, etc.

As guiding mechanism 50 returns to stored position 74, the player may using latch control to open latch 110, such that latch 110 may be configured to receive guiding mechanism 50. The player may use the latch control to close latch 110, such that closed latch 110 may retain guiding mechanism 50 in stored position 74.

Golf club 10 may facilitate providing standardization and consistency among players to definitively determine whether a ball is within "gimme" or predetermined distance.

While various embodiments of the invention have been described, it will be apparent to those of ordinary skill in the art that many more embodiments and implementations are possible that are within the scope of the invention.

The invention claimed is:

1. A golf club comprising:
a shaft;
a club head coupled to the shaft;
an actuator, wherein the actuator is coupled to the club head and is configured to actuate to facilitate moving a golf ball; and
a rotatable guiding mechanism coupled to at least one of the shaft and the club head, the guiding mechanism includes:
at least one guardrail; and
a receptacle coupled to the at least one guardrail, wherein the rotatable guiding mechanism facilitates guiding a golf ball between a first position and a second position.

2. A golf club in accordance with claim 1 wherein the guiding mechanism is configured to rotate between a stored position and an operative position.

3. A golf club in accordance with claim 2 wherein the guiding mechanism is substantially parallel to the shaft in the stored position and the guiding mechanism is angled with respect to the shaft in the operative position.

4. A golf club in accordance with claim 3 wherein the guiding mechanism is substantially perpendicular with respect to the shaft in the operative position.

5. A golf club in accordance with claim 1 further comprising a connection between the guiding mechanism and at least one of the shaft and the club head, wherein the connection facilitates rotating the guiding mechanism.

6. A golf club in accordance with claim 1 wherein the at least one guardrail has a first end and a second end, the first end is configured to couple to at least one of the club head and the shaft and the second end is configured to couple to the receptacle.

7. A golf club comprising:
a shaft;
a club head coupled to the shaft; and
a rotatable guiding mechanism coupled to at least one of the shaft and the club head, the guiding mechanism includes:
at least one guardrail;
a receptacle including at least one rim and at least one net, the receptacle coupled to the at least one guardrail, wherein the rotatable guiding mechanism facilitates guiding a golf ball between a first position and a second position; and
at least one grass guard, wherein the at least one grass guard is coupled to the at least one rim.

8. A golf club comprising:
a shaft;
a club head coupled to the shaft; and
a rotatable guiding mechanism coupled to at least one of the shaft and the club head, the guiding mechanism includes:
a pair of substantially parallel shafts;
at least one guardrail; and
a receptacle coupled to the at least one guardrail, wherein the rotatable guiding mechanism facilitates guiding a golf ball between a first position and a second position.

* * * * *